US005459953A

United States Patent [19]

Fukano et al.

[11] Patent Number: 5,459,953

[45] Date of Patent: Oct. 24, 1995

[54] MANIFOLD VALVE

[75] Inventors: Yoshihiro Fukano; Yoshitada Doi; Toshiyuki Mori, all of Ibaraki, Japan

[73] Assignee: SMC Kabushiki Kaisha, Tokyo, Japan

[21] Appl. No.: 241,584

[22] Filed: May 12, 1994

[30] Foreign Application Priority Data

May 12, 1993 [JP] Japan ..... 5-133863

[51] Int. Cl.[6] ..... F15B 13/043; F15B 13/08

[52] U.S. Cl. ..... 137/625.64; 137/596.16; 137/884

[58] Field of Search ..... 137/596.16, 625.64, 137/884

[56] References Cited

U.S. PATENT DOCUMENTS

| | | | |
|---|---|---|---|
| 3,215,158 | 11/1965 | Bass et al. | 137/596.16 X |
| 3,550,621 | 12/1970 | Lansky et al. | 137/884 |
| 4,469,128 | 9/1984 | Petrimaux et al. . | |
| 4,770,210 | 9/1988 | Neff et al. | 137/884 |
| 5,222,524 | 6/1993 | Sekler et al. | 137/884 |
| 5,333,647 | 8/1994 | Fukano et al. | 137/884 |

FOREIGN PATENT DOCUMENTS

| | | | |
|---|---|---|---|
| 2531151 | 2/1984 | France . | |
| 4037353 | 3/1992 | Germany . | |
| 5-18472 | 1/1993 | Japan | 137/884 |

*Primary Examiner*—Gerald A. Michalsky

*Attorney, Agent, or Firm*—Oblon, Spivak, McClelland, Maier & Neustadt

[57] ABSTRACT

In order to provide a manifold valve in which the overall height thereof can be lowered, a manifold base 10 is constituted by a fitting portion 18 with tube fittings 26, 28 being attached to output openings 22, 24 which open in a vertical direction on one side surface of the fitting portion 18, and a base portion 20 having a height lower than that of the fitting portion 18. A directional control valve 12 is constituted by a main valve 60 and a pilot valve 62 which is displaced upwardly from the main valve and attached at a height approximately equal to a difference in height between the fitting portion 18 and the base portion 20 from a lower surface of the main valve 60. The main valve 60 is disposed on the base portion 20, and the pilot valve 62 is disposed on or adjacent the fitting portion 18, wherein the directional control valve 12 is integrated with the manifold base 10. Since the height of the base portion 20 can be lowered owing to the displacement of the attachment position of the pilot valve 62 with respect to the main valve 60, the entire height and length of the manifold valve can be reduced.

16 Claims, 6 Drawing Sheets

MANIFOLD VALVE

BACKGROUND OF THE INVENTION

1. Field of the Invention

The present invention relates to a manifold valve in which directional control valves are provided on manifold bases.

2. Description of the Related Art

A manifold valve, in which directional control valves are installed on manifold bases each having a supply flow passage and exhaust flow passages for a pressurized fluid in order to collectively supply and exhaust the pressurized fluid to and from a plurality of directional control valves, has been already known, for which no special exemplary illustration may be necessary. In such a manifold valve, a plurality of directional control valves are arranged in a linking manner, whereby the pressurized fluid can be collectively supplied and exhausted to and from each of the directional control valves.

In the aforementioned manifold valve, two output ports, which are provided in each of the directional control valves, communicate individually with two output openings provided and opened on a frontal surface of the manifold base in a vertical direction through output flow passages provided in each of the manifold bases, and tube fittings for respectively connecting tubes are attached to the two output openings.

However, the aforementioned tube fittings are restricted in diameter in accordance with the diameters of the tubes inserted thereinto; and therefore, the tubes and tube fittings generally are required to have fixed predetermined diameters. Therefore, when two of such tube fittings are attached on the frontal surface of the manifold base in a vertical direction, a problem arises in that the manifold base necessarily has a large height, the entire manifold valve has a large occupying space, and it is impossible to make the apparatus compact.

A known type of manifold valve is shown in FIG. 12. The manifold valve 2 comprises a manifold base 4 and a directional control valve 6, wherein the directional control valve 6 is constituted by a main valve 8 and a pilot valve portion 9 including a solenoid. Therefore, since the directional control valve 6 is secured on the manifold base 4, it is inevitable that the height H1 and length L1 of the manifold valve 2 are extremely large because the pilot valve portion 9 protrudes on the side surface thereof.

This problem can be solved by allowing the two output openings to be provided and opened in a direction in which the manifold bases are linked together, namely in a horizontal direction. However, when the output openings are provided in such a horizontal direction, a difficult problem arises in that the manifold base has a large width, and the occupying space increases in the horizontal direction, also making the apparatus undesirably large in size.

On the other hand, when a directional control valve of an electromagnetic valve driven type is provided, in which a valve body is driven by a solenoid, the solenoid can be attached at a position above a lower surface of the main valve body.

SUMMARY OF THE INVENTION

It is a general object of the present invention to provide a manifold valve which is compact.

It is a main object of the present invention to provide a manifold valve which has a reduced overall height.

It is another object of the present invention to provide a manifold valve having a reduced overall width.

According to the present invention, there is provided a manifold valve which has one or more manifold bases and one or more directional control valves to be installed on the manifold bases, wherein:

each of the manifold bases comprises a fitting portion having a plurality of output openings which open on a side surface of the fitting portion, the output openings being disposed vertically one above the other, and a base portion having a height which is set to be lower than that of the fitting portion;

the base portion has a supply flow passage which communicates with a pressurized fluid supply port of the directional control valve and penetrates in a direction in which the directional control valves are linked together, one or more exhaust ports which communicate with one or more exhaust ports of the directional control valve and penetrate in the direction in which the directional control valves are linked together, and one or more output flow passages which have one ends communicating with one or more output ports of the directional control valve and other ends communicating with the output openings;

each of the directional control valves includes a main valve body in which the supply port, the output ports and the exhaust ports are defined, a valve member which is displaceably provided in the main valve body so that the output ports can communicate interchangeably with the supply port and the exhaust ports, and a pilot valve for driving the valve member which is displaced thereby, the pilot valve being attached at a height approximately equal to a difference in height between the fitting portion and the base portion from a bottom surface of the main valve body; and wherein the pilot valve is attached adjacent the fitting portion, and the main valve body is attached on the base portion, respectively.

It is further preferable that two of the exhaust flow passages and two of the output flow passages are defined in the base, and two of the exhaust ports and two of the output ports are provided in the main valve body.

It is further preferable that the valve member comprises a spool valve.

It is further preferable that the base portion and the fitting portion are integrated by means of attachment screws.

It is further preferable that the base portion and the fitting portion are integrated by means of an attachment clip.

It is further preferable that the pilot valve is attached and secured to the main valve body with the height of the fitting portion being set to be larger than the height of the manifold base by a distance $l_2$, and with a bottom surface of the pilot valve being displaced by a distance $l_1$ with respect to the bottom surface of the main valve body of the directional control valve, wherein the distances $l_2$ and $l_1$ are substantially identical.

It is further preferable in said manifold valve that the pilot valve is an electromagnetically driven type.

BRIEF DESCRIPTION OF THE DRAWINGS

Other objects and advantages of the present invention will become more apparent from preferred embodiments of the present invention which shall be explained in detail hereinafter with reference to the drawings, wherein.

DESCRIPTION OF THE PREFERRED EMBODIMENTS

Figure 7:
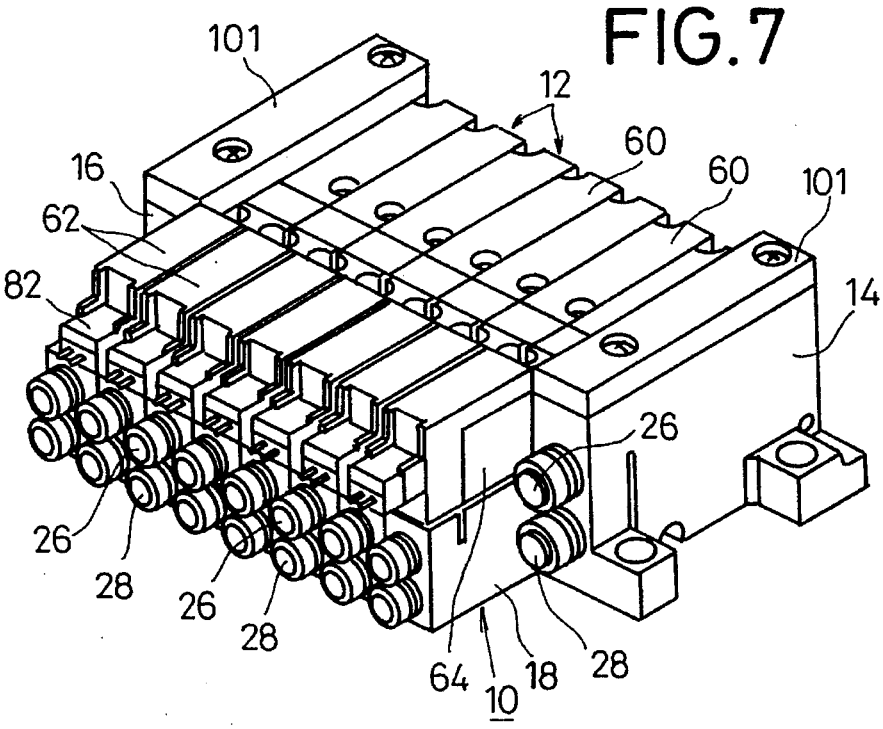
FIG. 7 is a perspective view of a valve assembly which is constituted by linking together a large number of manifold bases shown in FIG. 1 and a large number of directional control valves shown in FIG. 3, respectively.

FIG. 1 through FIG. 7 show a first embodiment of a manifold valve of the present invention. The aforementioned manifold valve of the first embodiment includes a plurality of manifold bases 10 and directional control valves 12 installed on the manifold bases 10. As shown in FIG. 7, a desired number of the aforementioned directional control valves can be disposed in a linking manner between end plates 14, 16. Each of the aforementioned manifold bases 10 includes a fitting portion 18 having a height approximately equal to those of known manifold bases, and a base portion 20 having a height lower than that of the fitting portion 18 and being attached to one end surface of the fitting portion 18 by means of an attachment means described below.

Two output openings 22, 24 are provided and opened in the fitting portion 18 to the other end surface thereof in a vertical direction, namely in an upright direction as shown in the figure, and so-called one-touch tube fittings 26, 28 are fitted into the output openings. As clearly understood from FIG. 1, the passages 30, 32 are defined in the fitting portion and have opening cross-sectional areas which converge from one side surface to the other side surface of the fitting portion 18.

On the other hand, the base portion 20 includes a supply opening 34 for a pressurized fluid, output openings 36, 38 and exhaust openings 40, 42 each of which open on an upper surface of the base portion. The supply opening 34 and the exhaust openings 40, 42 individually communicate with a supply flow passage 44 and exhaust flow passages 46, 48 penetrating through the base portion 20 in a direction perpendicular to the plane of FIG. 1, namely in a direction in which the base portion 20 is linked together with other base portions 20. The output openings 36, 38 individually communicate with the aforementioned output openings 22, 24 through output flow passages 50, 52. The output flow passages 50, 52 also respectively communicate with the passages 30, 32 in the fitting portion 18. Further, attachment holes 54, 56, penetrate through the base portion 20 in the direction perpendicular to the plane of FIG. 1, namely in the direction in which the base portions 20 are linked together. Such attachment holes 54, 56 are provided for allowing tie rods (not shown) to pass therethrough for linking and clamping the base portions 20 together. Further, the base portion 20 is attached to one end surface of the fitting portion 18 by means of attachment screws 58.

Since the fitting portions 18 of the respective manifold bases 10 are aligned at a height approximately equal to those of known manifold bases, the tube fittings 26, 28 can have diameters necessary for insertion of standard-sized tubes (not shown). The axes of the output openings 22,24 are non-coaxial with those of the passages 50,52 in the base 20. The openings 22,24 are instead spread to take advantage of the wider space made available by the height of the fitting portion 18.

Incidentally, the fitting portion 18 and the base portion 20 are separately formed in the illustrated embodiment, however, it is easily understood that they may be formed as an integrated unit.

Next, the directional control valve 12 to be secured to the aforementioned manifold base 10 will be explained.

Figure 1:
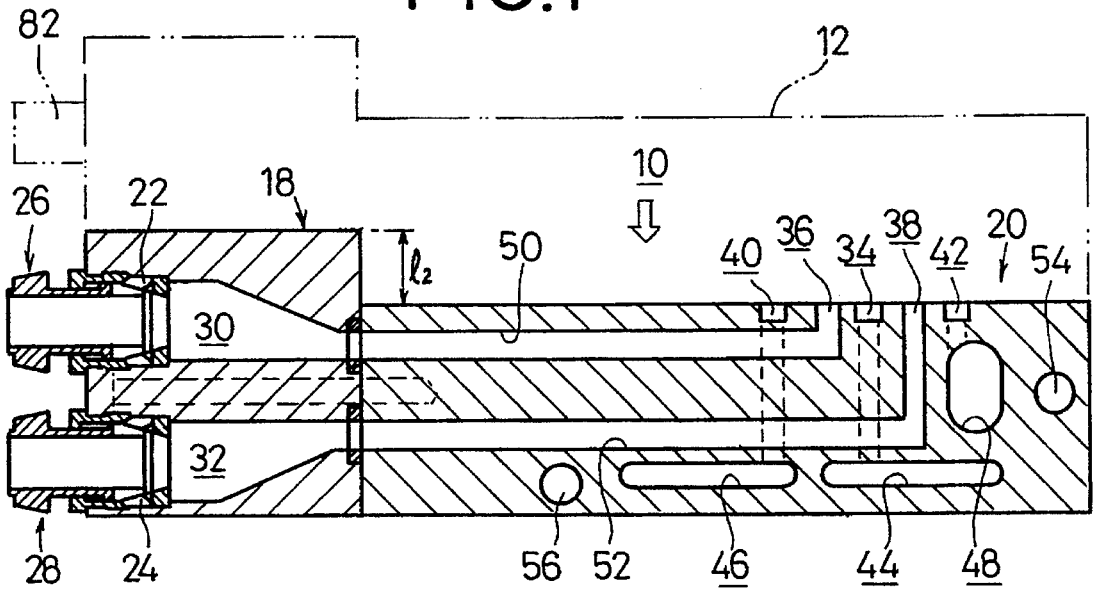
FIG. 1 is a vertical cross-sectional side view of a manifold base which constitutes a manifold valve of a first embodiment of the present invention.
Figure 2:
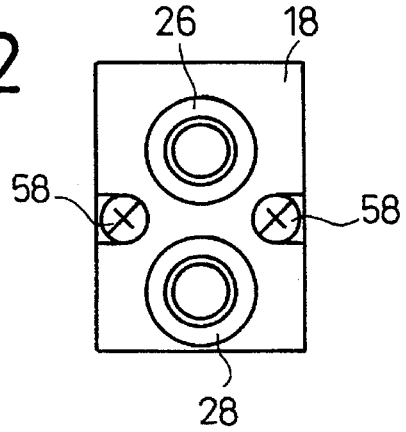
FIG. 2 is a front view of the manifold valve shown in FIG. 1.
Figure 3:
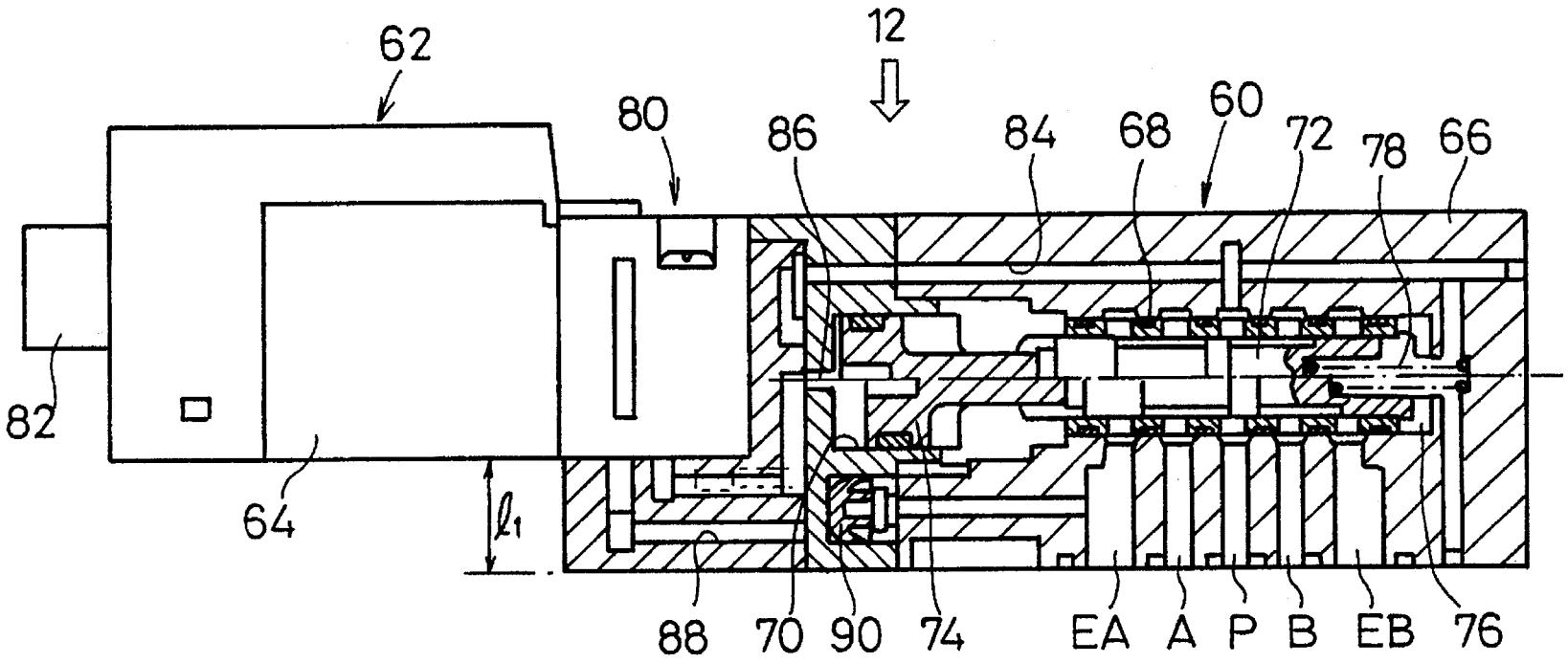
FIG. 3 is a vertical cross-sectional side view of a principal part of a directional control valve which constitutes the manifold valve of the first embodiment of the present invention.

The directional control valve 12, which is illustrated in detail in FIG. 3, is constituted by a main valve 60 and an electromagnetically driven pilot valve 62 which drives a valve body of the main body 60 described below. However, the directional control valve 12 of the present invention is not limited thereto, and other directional control valves which are directly driven, i.e. in which a valve body is directly driven by a solenoid, may also be employed in the context of the present invention.

A main valve body 66 of the aforementioned main valve 60 has a substantially rectangular shape, and on its lower surface are aligned a supply port P for a pressurized fluid, output ports A, B and exhaust ports EA, EB, wherein each of these ports opens to a valve hole 68. When the main valve body 66 is installed on the base portion 20, the ports P, A, B, EA, EB communicate with the corresponding supply opening 34, output openings 36, 38 and exhaust openings 40, 42 respectively in an air-tight manner.

The valve hole 68 is defined in and extends in a longitudinal direction of the main valve body 66. A piston chamber 70 having a diameter larger than that of the valve hole 68 is further provided at one side end, and a back chamber 76 is provided at the other side end. A restoring spring 78 is provided at one side of the back chamber 76, so as to constantly press a valve member 72 toward the side of the piston chamber 70. The valve member 72, which is slidably inserted in the aforementioned valve hole 68, comprises a spool valve. The spool valve is displaced in accordance with comparative magnitudes between an operation force of a pilot fluid pressure acting on a piston 74 sliding in the piston chamber 70 and the sum of an operation force of a supply fluid pressure acting on the back chamber 76 at a side opposite to the piston due to a difference between pressure-receiving areas of the valve body 72 and an energizing force of the restoring spring 78. Accordingly, the valve member 72 permits the output ports A and B be be brought into communication interchangeably with the supply port P and the exhaust ports EA and EB.

A manual operating portion 80, which is provided for supplying a pilot fluid to the piston chamber 70 during accidents such as a power failure and the like, is attached between the aforementioned main valve body 66 and the pilot valve 62. When a manual operating button (not shown) provided in the manual operating portion 80 is depressed, compressed air in the supply port P can be directly supplied to the piston chamber 70.

The pilot valve 62 includes a pilot supply port, a pilot output port and a pilot exhaust port (none of which are shown). The pilot valve comprises a well known three-port electromagnetic valve, in which magnetic excitation of a solenoid 64 is are used to permit the pilot output port to communicate interchangeably with the pilot supply port and the pilot exhaust port. As shown in FIG. 3, the pilot valve 62 is attached at a position upwardly displaced by a distance $l_1$ from a lower surface of the main valve body 66, the displacement amount being approximately equal to the difference in height $l_2$ between the fitting portion 18 and the base portion 20. Further, the aforementioned solenoid 64 is provided with a connector 82 on a frontal surface thereof so as to make it possible to supply electric power from the frontal surface of the pilot valve 62.

Further, the pilot supply port (not shown) communicates with the supply port P of the main valve body 66 through a pilot supply passage 84, the pilot output port communicates with the piston chamber 70 through a pilot output passage 86, and the pilot exhaust port communicates with the exhaust port EA of the main valve body 66 through a pilot exhaust passage 88, respectively. A check valve 90, which prevents exhaust gas exhausted from the main valve 60 from flowing into the pilot valve 62, is installed in the pilot exhaust passage 88.

Incidentally, the directional control valve of the aforementioned embodiment is a five-port valve, however, the directional control valve of the present invention can be a four-port valve in which the exhaust ports EA, EB are commonly used to reduce the number of ports.

Figure 4:
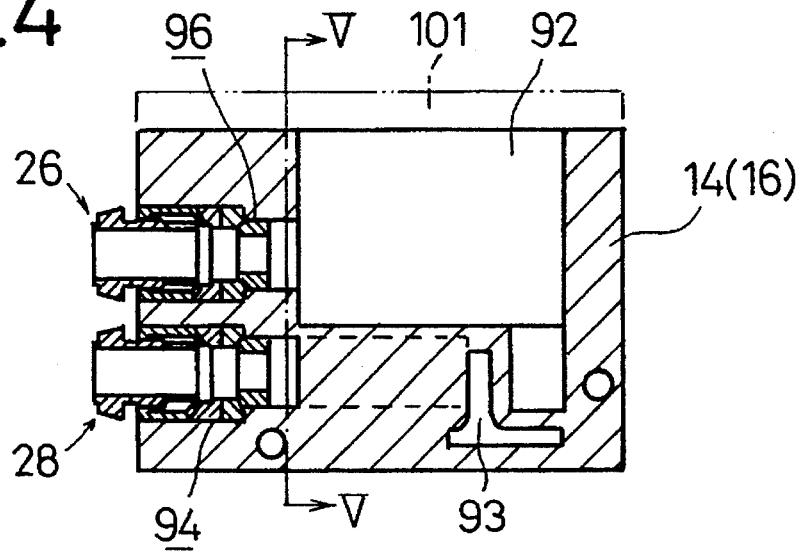
FIG. 4 is a vertical cross-sectional side view of an end plate for closing one side surface of the directional control valve shown in FIG. 3.
Figure 5:
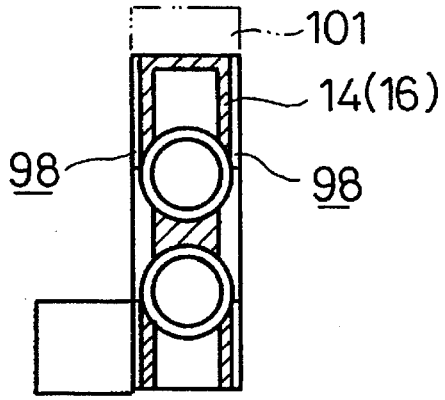
FIG. 5 is a cross-sectional view of the end plate shown in FIG. 4 taken along a line V—V.
Figure 6:
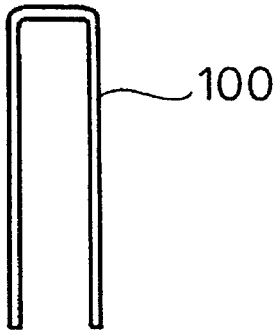
FIG. 6 is a front view of an attachment clip for incorporating tube fittings into the end plate shown in FIG. 5.

As shown in FIG. 4 and FIG. 5, each of the aforementioned end plates 14, 16 has passages 92, 93 which communicate with the supply flow passage 44 and the exhaust flow passages 46, 48 of the base portion 20, and a supply opening 94 and an exhaust opening 96 which individually communicate with the passages 92, 93 and open on a frontal surface of each of the end plates 14, 16. The aforementioned one-touch tube fittings 26, 28 are attached to the supply opening 94 and the exhaust opening 96 by means of a U-shaped attachment clip 100 (see FIG. 6) having elastic force, the clip 100 being inserted into attachment holes 98.

Incidentally, in the figure, reference numeral 101 indicates a cover for covering an upper surface of each of the end plates 14, 16.

In the aforementioned first embodiment, when the fitting portion 18 is attached to the frontal surface of the base portion 20 by means of the attachment screws 58, the manifold base 10 is formed. When the main valve body 66 of the main valve 60 is disposed on the base portion 20 of the manifold base 10, the pilot valve 62 is disposed on the fitting portion 18, respectively, and an attachment screw 102 is screwed into the base portion 20 through an attachment hole provided in the main valve body 66. Then the directional control valve 12 is attached on the manifold base 10 (see FIG. 7).

In this case, because the pilot valve 62 of the directional control valve 12 is displaced upwardly from the lower surface of the main valve body 66 by a height $l_1$, which is approximately equal to the difference $l_2$ in height between the fitting portion 18 and the base portion 20, the upper portion of the fitting portion 18 can be disposed in a space which is formed by the displacement. In other words, the two tube fittings can be vertically arranged without causing any significant increment in the height and width of the overall apparatus.

Further, the supply of electric power to the solenoid, and the connection of tubes to the tube fittings, can be performed at frontal positions of the manifold valve, so that the area required for installation thereof can be greatly reduced, as compared with a case in which the electric power supply and output of pressurized fluid are performed in separate directions.

The operation of the valve body 72 according to the first embodiment, which employs magnetic excitation of the solenoid 64 of the pilot valve 62, is basically the same as those of known directional control valves, so that a detailed explanation thereof is omitted.

Figure 8:
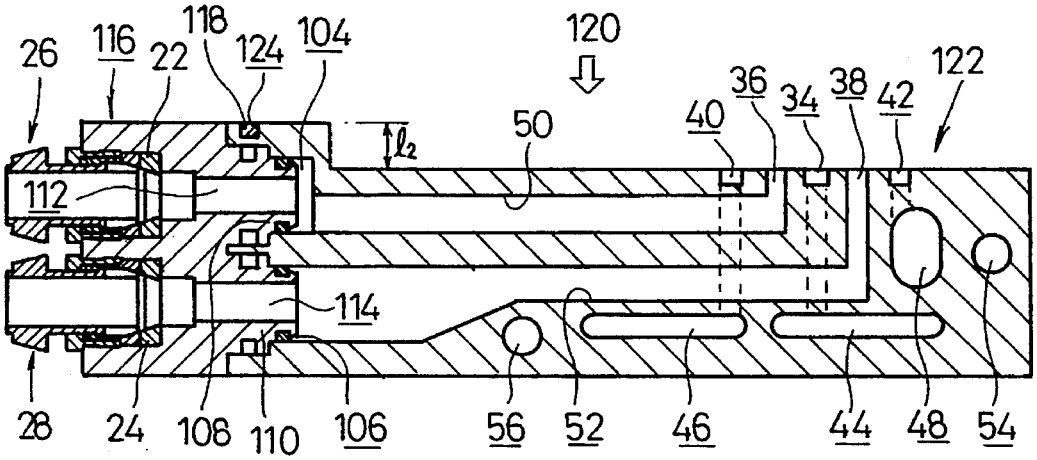
FIG. 8 is a vertical cross-sectional side view of a principal part of a manifold base for a manifold valve according to a second embodiment of the present invention.

FIG. 8 shows a second embodiment of a manifold valve according to the present invention. The manifold valve 120 of the second embodiment has a base portion 122 which has approximately the same construction as that of the base portion 20 of the first embodiment, and a fitting portion 116 which is fitted to output flow passages 50, 52 of the base portion. One end of the base portion 122 is elevated by a similar distance $l_2$ as illustrated in the first embodiment, and such a height is utilized to define concave portions 104, 106 into which the fitting portion 116 is fitted. The fitting portion 116 has projections 108, 110 to be fitted into the aforementioned concave portions 106, 108. Passages 112, 114 are provided directed toward the tube fittings 26, 28 and extending from the projections 108, 110. The fitting portion 116 is attached to the base portion 122 by means of a U-shaped attachment clip 118 inserted into attachment grooves 124 formed in the fitting portion 116, in the same manner as the end plates 14, 16.

The remaining structure and operation of the second embodiment are the same as those of the first embodiment, so that principal portions in the figure are designated by like reference numerals, and a detailed explanation thereof is omitted.

In the second embodiment, instead of using attachment screws 58, an attachment clip 118 is employed to integrate the fitting portion 116 with the manifold base 120. Therefore, an advantageous effect is obtained in that handling of the apparatus and the components thereof becomes easy.

Figure 9:
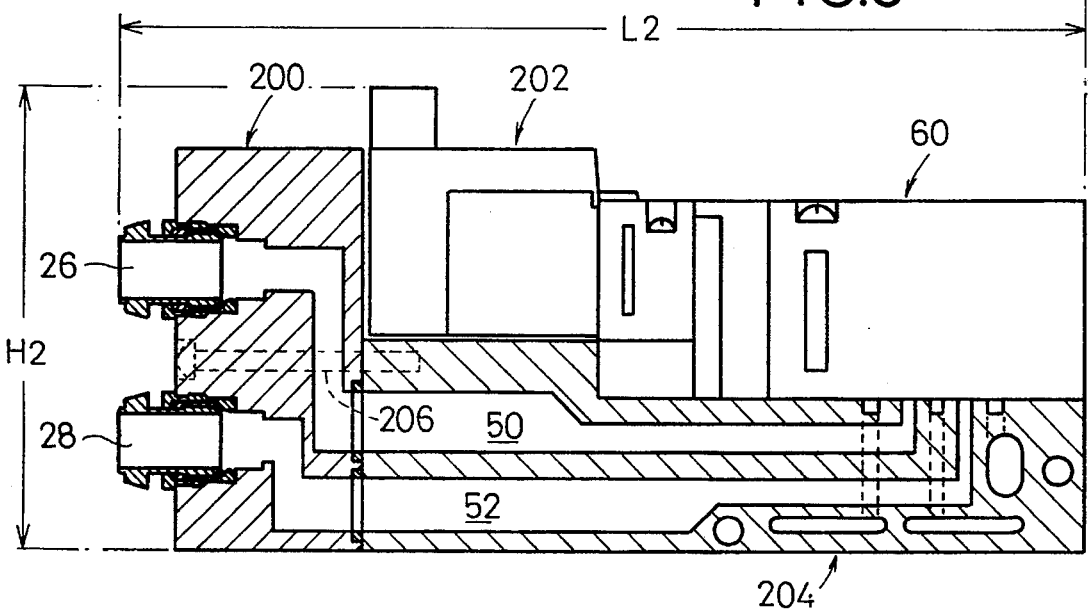
FIG. 9 is a vertical cross-sectional side view of a principal part of a third embodiment of a manifold valve of the present invention.

FIG. 9 shows a third embodiment of a manifold valve according to the present invention. As easily understood from the figure, a fitting portion 200 and a pilot valve portion 202 are set to have a substantially identical height H2. A manifold base 204 is connected to the fitting portion 200 by means of bolts 206.

Figure 10:
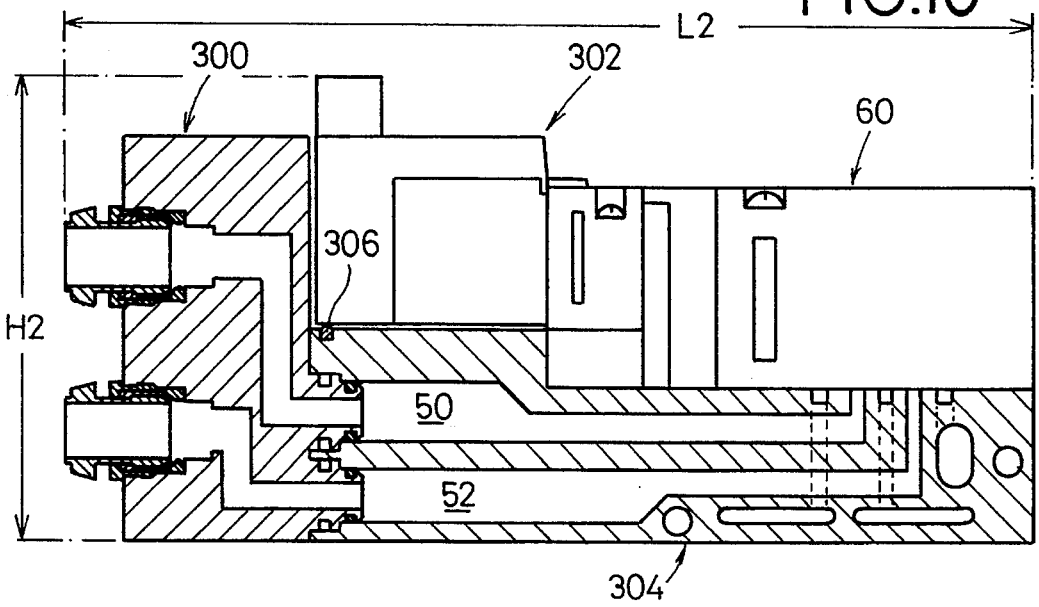
FIG. 10 is a vertical cross-sectional side view of a principal part of a fourth embodiment of a manifold valve of the present invention.
Figure 11:
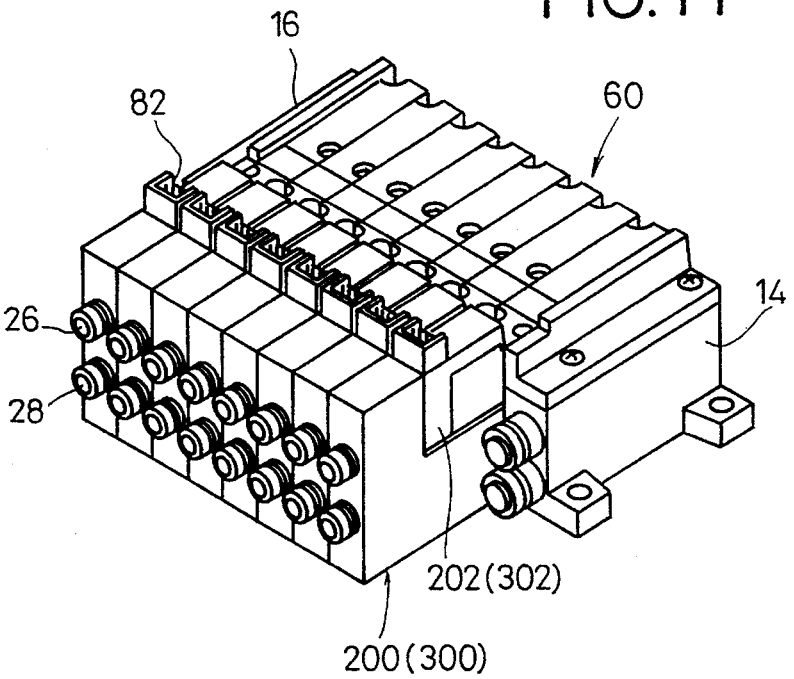
FIG. 11 is a perspective explanatory view of the manifold valve shown in FIG. 9 or 10.

FIG. 10 shows a fourth embodiment of a manifold base according to the present invention. As easily understood from the figure, a fitting portion 300 and a pilot valve portion 302 are set to have the substantially identical height H2 as in the third embodiment. However, the manifold base 304 is connected to the fitting portion 300 by means of an attachment clip 306.

It will be easily and clearly understood that the pilot valve portions 202, 302 are respectively arranged behind of the fitting portions 200, 300 in the aforementioned embodiments in FIG. 9 and FIG. 10. Furthermore, the fitting portions 200, 300 have passages extending therethrough in a bent or serpentine form, wherein the tube fittings 26, 28 are connected to respective ends of the passages, and wherein the other ends of the passages communicate with the output flow passages defined in the manifold bases 204, 304.

Figure 12:
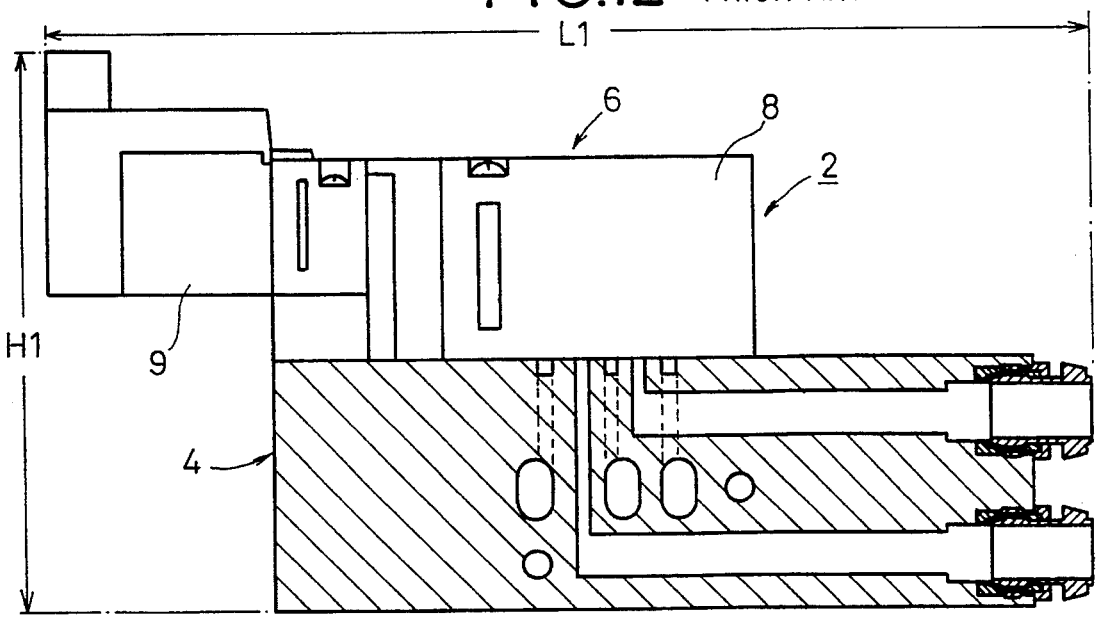
FIG. 12 PRIOR ART
FIG. 12 is a vertical cross-sectional view of a principal part of a manifold valve according to a known arrangement.

In the third and fourth embodiments as described above, because the pilot valve portions 202, 302 are disposed behind the fitting portions 200, 300, the length L2 of the directional control valve constituted by the pilot valve portion 202, 302 and the main valve 60 can be shorted, so that the overall length L2 of the manifold valve is reduced when compared to the length L1 of the known arrangement shown in FIG. 12.

In the manifold valve of the present invention, the solenoid which drives the directional control valve main body is attached so as to be displaced upwardly by a distance $l_1$ from a lower surface of the directional control valve. Accordingly, tube fittings having predetermined diameters can be disposed vertically on the fitting portion of the manifold base, which has a height higher than that of the base portion thereof by a distance $l_2$, while the overall height of the base portion is lowered.

More specifically, according to the first and second embodiments, when the directional control valve is attached on the manifold base by disposing the solenoid on the fitting portion of the manifold base and disposing the main valve body on the base portion respectively, the fitting portion having a height higher than that of the base portion of the manifold base is disposed underneath the solenoid, which is attached with an upward displacement from the lower surface of the main valve body. Thus, the main valve body of the directional control valve is attached to the base portion at a low height, so that the entire height of the manifold valve can be lowered.

Furthermore, according to the third and fourth embodiments, the fitting portion of the manifold base is constructed with serpentine passages therein so that the a height of the fitting portion is substantially equal to the overall height of the manifold valve, whereby the solenoid is disposed on top of the manifold base behind the fitting portion. Thus, the overall length of the manifold valve is shorted as compared with previously known arrangements.

In the present invention, even through the entire height of the manifold valve is lowered, the height of the fitting portion can be made approximately the same as those of known manifold bases, so that the two tube fittings having predetermined standard diameters can be attached in a vertical direction on the narrow width side surface of the manifold base.

Therefore, the overall height and length of the manifold valve are reduced, and hence the height and length dimensions of the manifold valve, as well as the installation space required therefor, can be kept small, resulting in a highly compact manifold valve.

What is claimed is:

1. A manifold valve, comprising:

at least one manifold base, said manifold base comprising a fitting portion having a plurality of output openings which open on a side surface thereof, and a base portion having a height which is lower than that of the fitting portion; and at least one directional control valve installed on said manifold base, said direction control valve comprising a pressurized fluid supply port, at least one exhaust port, and a plurality of output ports;

wherein said base portion comprises a supply flow passage which communicates with said pressurized fluid supply port of said directional control valve, at least one exhaust port which communicates with said at least one exhaust port of said directional control valve, and a plurality of flow passages, each of said flow passage having one end communicating with a respective output port of said directional control valve and another end communicating with one of said output openings, wherein a central axis of at least one output opening is non-coaxial with a central axis of the flow passage to which said at least one output opening is connected;

wherein said directional control valve comprises a main valve body in which said supply port, said output ports and said at least one exhaust port are defined, a valve member which is displaceably provided in a valve hole in said main valve body so as to permit said output ports to be brought into communication interchangeably with the supply port and said at least one exhaust port, and a pilot valve for driving said valve member, wherein said pilot valve is displaced upwardly from said main valve body and attached to said main valve body at a predetermined height from a bottom surface of the main valve body; and wherein said pilot valve is attached adjacent the fitting portion, and the main body is attached on the base portion, respectively.

2. The manifold valve according to claim 1, wherein said plurality of flow passages in said base portion comprise two exhaust flow passages and two output flow passages, further comprising two exhaust ports and two output ports provided in said main valve body.

3. The manifold valve according to claim 1, wherein said valve member comprises a spool valve.

4. The manifold valve according to claim 1, wherein said base portion and said fitting portion are connected together by means of attachment screws.

5. The manifold valve according to claim 1, wherein said base portion and said fitting portion are connected together by means of an attachment clip.

6. The manifold valve according to claim 1, wherein said pilot valve is disposed on top of said fitting portion, said fitting portion having a height greater than the height of said manifold base by a distance $l_2$, and wherein a bottom surface of said pilot valve is displaced upwardly by a distance $l_1$ with respect to the bottom surface of the main valve body of said directional control valve, said distances $l_2$ and $l_1$ being substantially identical.

7. The manifold valve according to claim 1, wherein said pilot valve is disposed on top of said manifold base behind said fitting portion, said fitting portion having a height substantially equal to an upper surface of said pilot valve, and wherein a bottom surface of said pilot valve is displaced upwardly with respect to a bottom surface of the main valve body of said direction control valve.

8. The manifold valve according to claim 1, wherein the pilot valve is an electromagnetically driven type.

9. A manifold valve, comprising:

a plurality of manifold bases, each of said manifold bases comprising a fitting portion having a plurality of output openings which open on a side surface thereof, and a base portion having a height which is set to be lower than that of the fitting portion; and a plurality of linked directional control valves, each of said directional control valves being installed respectively on said manifold bases, each of said directional control valves comprising a pressurized fluid supply port, at least one exhaust port, and a plurality of output ports;

wherein said base portion comprises a supply flow passage which communicates with said pressurized fluid supply port of one of said directional control valves and which penetrates in a direction in which the directional control valves are linked together, at least one exhaust port which communicates with at least one exhaust port of one of said directional control valves and which penetrates in the direction in which said directional control valves are linked together, and a plurality of flow passages, each of said flow passages having one end communicating with a respective output port of one of said directional control valves and another end communicating with one of said output openings, wherein a central axis of at least one output opening is non-coaxial with a central axis of the flow passage to which said at least one output opening is connected;

wherein each of said directional control valves comprises a main valve body in which said supply port, said output ports and said at least one exhaust port are defined, a valve member which is displaceably provided in a valve hole in said main valve body so as to permit said output ports to be brought into communication interchangeably with said supply port and said at least one exhaust port, and a pilot valve for driving said valve member, wherein said pilot valve is displaced upwardly from said main valve body and attached to said main valve body at a predetermined height from a bottom surface of the main valve body; and wherein said pilot valve is attached adjacent the fitting portion, and the main valve body is attached on the base portion, respectively.

10. The manifold valve according to claim 9, wherein said plurality of flow passages in said base portion comprise two exhaust flow passages and two output flow passages, further comprising two exhaust ports and two output ports provided in said main valve body.

11. The manifold valve according to claim 9, wherein said valve member comprises a spool valve.

12. The manifold valve according to claim 9, wherein said base portion and said fitting portion are connected together by means of attachment screws.

13. The manifold valve according to claim 9, wherein said base portion and said fitting portion are connected together by means of an attachment clip.

14. The manifold valve according to claim 9, wherein said pilot valve is disposed on top of said fitting portion, said fitting portion having a height greater than the height of said manifold base by a distance $l_2$, and wherein a bottom surface of said pilot valve is displaced upwardly by a distance $l_1$ with respect to the bottom surface of the main valve body of said directional control valve, said distances $l_2$ and $l_1$ being substantially identical.

15. The manifold valve according to claim 9, wherein said pilot valve is disposed on top of said manifold base behind said fitting portion, said fitting portion having a height substantially equal to an upper surface of said pilot valve, and wherein a bottom surface of said pilot valve is displaced upwardly with respect to a bottom surface of the main valve body of said direction control valve.

16. The manifold valve according to claim 9, wherein the pilot valve is an electromagnetically driven type.

* * * * *